United States Patent [19]

Johnson

[11] Patent Number: 4,514,993

[45] Date of Patent: May 7, 1985

[54] INSULATED BARREL COOLER

[75] Inventor: Randolph K. Johnson, Bartlesville, Okla.

[73] Assignee: Idttkow, Inc., Bartlesville, Okla.

[21] Appl. No.: 585,453

[22] Filed: Mar. 2, 1984

[51] Int. Cl.[3] ..... F25D 3/08

[52] U.S. Cl. ..... 62/372; 62/457

[58] Field of Search ..... 62/371, 372, 457

[56] References Cited

U.S. PATENT DOCUMENTS

| | | | |
|---|---|---|---|
| 2,017,504 | 10/1935 | Lohner | 62/372 |
| 2,071,303 | 2/1937 | Hill | 62/372 |
| 2,216,330 | 10/1940 | Stover | 62/372 |
| 3,338,068 | 8/1967 | Piker | 62/457 X |
| 3,443,397 | 5/1969 | Donovan et al. | 62/457 X |
| 3,614,875 | 10/1971 | McCallum | 62/457 X |
| 3,998,072 | 12/1976 | Shaw | 62/457 |

*Primary Examiner*—Lloyd L. King

*Attorney, Agent, or Firm*—Head, Johnson & Stevenson

[57] ABSTRACT

A barrel cooler comprising a cylindrical, open ended, insulated cloth sleeve or jacket that slips over a beer keg or the like to keep the barrel cold. The insulated cloth sleeve is fabricated from a single piece of fabric by folding the fabric in thirds longitudinally with the insulation layer therebetween and then stitching the bottom circumferentially. A plurality of vertically stitched seams displaced equal distance around the sleeve create internal pockets in which are placed plastic bags of frozen water or the like to cool the barrel.

3 Claims, 3 Drawing Figures

INSULATED BARREL COOLER

BACKGROUND OF THE INVENTION

1. Field of the Invention

This invention relates to an insulated barrel cooler. More specifically, this invention relates to an insulated cylindrical beer keg cooler jacket with a plurality of pockets within the jacket that contain plastic bags of water or other refreezeable liquid.

2. Description of the Prior Art

It is generally known and a common practice to cool beer kegs (e.g., ponies, quarter barrels, half barrels, tappers and the like) by immersing the keg in an open container such as a washtub or cut down 55 gallon drum filled with ice. Such a practice is somewhat inconvenient, messy and involves considerable effort and labor before and after use. In the past, several cooler devices have been proposed with limited commercial success as alternatives to the bathtub of ice concept. For example, U.S. Pat. Nos. 3,443,397 and 3,614,875 disclose beer keg coolers essentially involving a bag filled with ice completely surrounding the barrel. However, such devices do not solve the inherent problem associated with disposing of the water produced after the ice melts, nor do these devices represent a significantly insulated apparatus. Also, in U.S. Pat. No. 4,344,303 a beverage container cooler is disclosed for keeping individual servings of beverage cold by use of a foamed insulated layer or external cup such as the contemporary popular beer can insulator, but with a plurality of fluid containing cavities embedded within the foam and filled with "blue ice" that can be frozen before use. However, such a device is not structurally amenable to being scaled up to the beer keg application.

SUMMARY OF THE INVENTION

In view of the prior art devices and the problems associated with maintaining a beer keg or the like cold during use, I have discovered an improved barrel cooler comprising:

(a) an insulated cloth pocketed sleeved member having at least four concentrically sleeved layers further comprising:

(i) a first outer cloth layer;

(ii) an inner layer of cloth insulation;

(iii) a second inner cloth layer attached circumferentially to the first outer cloth layer at the top and at the bottom of the pocketed sleeved member thus confining the inner layer of cloth insulation therebetween;

(iv) a third inner layer of cloth attached circumferentially to the second inner layer and the first outer layer at the bottom of the pocketed sleeved member with the top of the third inner layer of cloth being open; and (v) a plurality of vertical seams in the sleeved member displaced essentially equal distance around the sleeved member thus creating a plurality of internal open topped pockets between the second and third inner layers of cloth; and (b) a plurality of plastic bags adapted to hold a freezeable liquid and further adapted to be inserted into the pockets to cool an object placed within the insulated cloth pocketed sleeved member.

Thus, according to the present invention, the barrel cooler can be fabricated from a single continuous sheet of cloth by folding the cloth longitudinally about the one-third and two-third width positions with the layer of cloth insulation inserted between the first and second folded layers and then stitched closed at the lower folded end. For convenience, cloth carrying handles or straps that are snap releaseable can be attached to the top of the barrel cooler.

It is an object of the present invention to provide a barrel cooler which is inexpensive, pleasing in appearance, leak proof and collapsible for ease of delivery and storage. It is a further object to provide a barrel cooler which is externally insulated and internally equipped with pockets that receive individual plastic bags containing a freezeable liquid. It is a further object to provide frozen bags that can be inserted into the pockets of the barrel cooler during use and subsequently removed after the ice melts for refreezing, thus by-passing the problems associated with melting ice. Fulfillment of these objects and the presence and fulfillment of additional objects will be apparent upon complete reading of the specification and claims taken in conjunction with the attached drawings.

DESCRIPTION OF THE PREFERRED EMBODIMENTS

The barrel cooler according to the present invention, how it is made, and how it is used as well as how it differs from the prior art devices and the advantages over the prior art devices can perhaps be best explained and understood by reference to the drawings.

Figure 1:
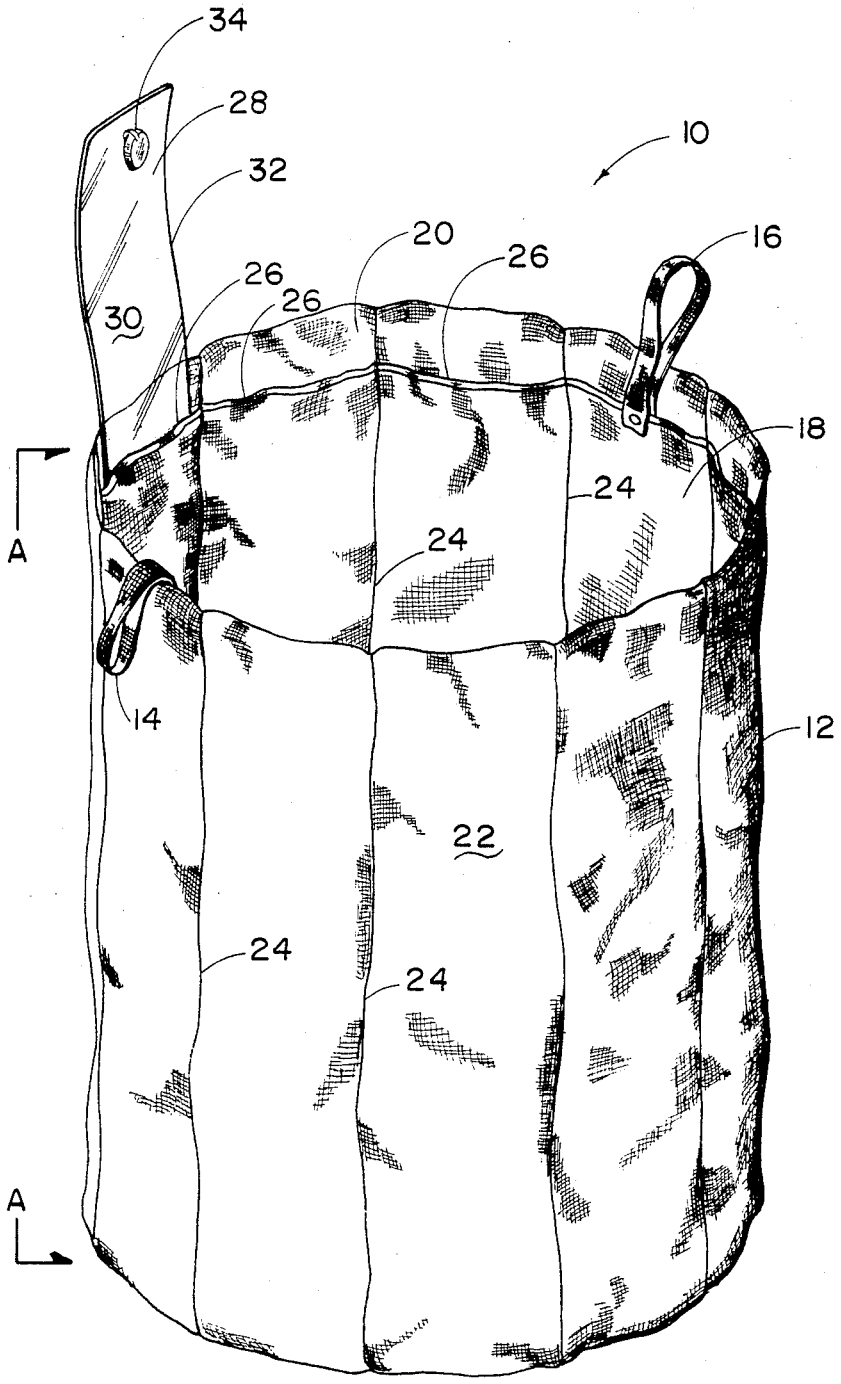
FIG. 1 is a perspective view of a barrel cooler according to the present invention with a plastic ice bag partially inserted into an interior pocket.

FIG. 1 illustrates a perspective view of a barrel cooler, generally designated by the number 10, according to the present invention. As illustrated, the barrel cooler 10 is made from fabric and is sewn or otherwise assembled into generally a cylindrical sleeve or jacket 12 with preferable an open top and bottom. In this manner, the barrel cooler 10 can be readily slipped over a beer keg or the like and the top of the keg will still be accessible for a spigot and pump.

As further illustrated in FIG. 1, the top of the jacket 12 is equipped with a pair of cloth handles 14 and 16 stapled to the inner cloth layer 18 which in this particular illustrated embodiment terminates just short of the top of the overall device, thus visually exposing a second inner layer 20 above the top of innermost layer 18. In other words, the cylindrical cloth sleeve 12 of the beer cooler 10 according to the present invention is fabricated from at least three layers of cloth (an outer layer 22, a first inner layer 20 and a second innermost layer 18).

As further illustrated in FIG. 1, these three cloth layers are stitched or sewn along a plurality of vertical seams 24 which divide or form the inner layers 18 and 20 into a plurality of individual pockets 26 on the interior of the cooler 10. These pockets are intended to receive a plurality of elongated plastic bags 28. Each plastic bag 28 (see FIG. 3) is preferably made from flat laminated plastic film 30 sealed at the perimeter 32 of the bag 28. A relatively flat cap 34 is positioned at one end of the bag 28 intentionally short of the end. In this manner, the bag 28 can be partially filled with water (up to the lip of the cap 34), sealed with some trapped air therein and laid or stacked flat in a freezer such that the water or other solution freezes into a rigid flat water proof bag. These prefrozen bags 28 can then be inserted into the pockets 26 (see FIG. 1) to cool the beer keg and subsequently removed, replaced or reused once the liquid melts without spilling or mess.

Figure 2:
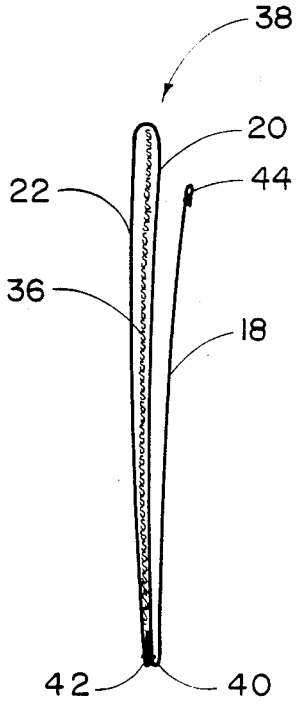
FIG. 2 is a cross-sectional view of the cloth sidewall structure of the barrel cooler of FIG. 1 as seen through line A—A.

As seen in FIG. 2, the cross-section of the sidewall jacket 12 involves a layer of cloth insulation 36 sandwiched between outer cloth layer 22 and inner cloth layer 20. FIG. 2 further illustrates that all three successive layers 18, 20, and 22 can be fabricated from a single continuous sheet of cloth. To accomplish this, the cloth is folded longitudinally at approximately one-third of the width of the cloth, thus forming the top fold 38. The second longitudinal fold is made at approximately the two-third width position, thus forming the bottom fold 40. The layer of insulating cloth 36 is inserted between the outer layer 22 and the first inner layer 20 and the appropriate seam is stitched or sewn at what is the bottom 42 of the barrel cooler 10. An additional folded seam is made at the top 44 of the innermost layer 18. The respective vertical pocket seams 24 can then be made and the final assembly of the insulated cloth pocketed sleeved cooler 10 can be performed by adding the optional handles 14 and 16 and making the final vertical finishing seams 24.

In order to manufacture a barrel cooler according to the present invention and compatible with a contemporary beer key, a jacket circumference of approximately 55 inches in length with seams approximately every five inches is preferred. The jacket preferably is about eighteen inches tall, thus capable of fitting more than one size of beer keg. Preferably, the cloth employed as the outer layer is a relatively strong and durable material, such as denim, burlap, leno weave polypropylene (scrim material) or the like. Optionally, the innermost layer of cloth in contact with the beer keg can be thinner and/or more thermally conductive than the outer layers (e.g., sailcloth, parachute nylon, or the like). Preferably, a denim is used for all three layers. Such material can be assembled or fabricated by any of the methods well known in the art; including by way of example, but not limited thereto; sewing or stitching, cloth glue and adhesives, or various cloth fasteners such as rivets, staples and the like.

The optional handles can be positioned and attached at various points around the top of the cooler. They can be made out of essentially any material well known in the art, including cloth, leather, plastic or the like. Preferably, a pair of nylon straps positioned at opposite sides of the jacket corresponding to the relative position of the handles on the keg are employed. These handles are preferably attached to the jacket by snaps so that they may be unsnapped, inserted through the handles on the keg, and then resnapped, thus holding the barrel cooler in place.

Figure 3:
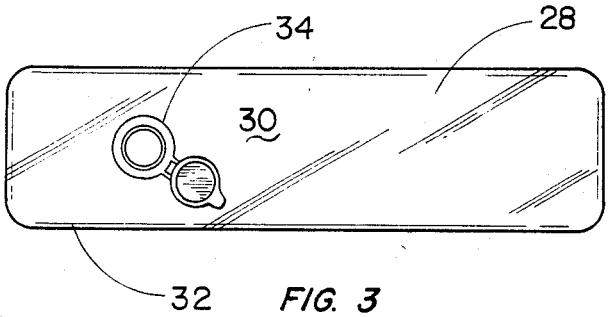
FIG. 3 is a top plan view of a plastic container for storing a freezeable liquid and for insertion into the interior pocket of the barrel cooler according to the present invention.

The plastic bags to be inserted into the pockets of the barrel cooler are preferably made from laminating two layers of plastic film. The plastic employed is essentially any material well known in the art compatible with low temperature applications including, by way of example, but not limited thereto, vinyls, polyolefins, nylons or other polyimides and the like. Preferably, a transparent film of plasticized pvc is employed. In the above beer keg application, eleven four inch by sixteen inch by one inch plastic inserts are used. Each insert can contain up to about twentyfour ounces of water. The inserts are either heat sealed during manufacturing with appropriate amounts of water already present or an optional sealing cap as illustrated in FIG. 3 or the equivalent can be employed. Prior to use, the inserts are laid flat and frozen solid. The inserts are then placed into the pockets of the jacket and the jacket is fitted to the keg or in the alternative, the jacket is fitted to the keg and the inserts are then inserted into the pockets. The selection of the liquid or fluid placed in the plastic bag inserts can again be any such material as well known in the art, including water, various aqueous solutions, including the so-called "blue ice" and the like. Preferably water is employed.

Having thus described the preferred embodiments with a certain degree of particularity, it is manifest that many changes can be made in the details of the invention without departing from the spirit and scope of the invention. Therefore, it is to be understood that the invention is not limited to the embodiments set forth herein for purposes of exemplification, but is to be limited only by the scope of the attached claims, including a full range of equivalents to which each element thereof is entitled.

I claim:

1. A barrel cooler comprising:

(a) an insulated cloth pocketed sleeved member having at least four concentrically sleeved layers further comprising:

(i) a first outer cloth layer;

(ii) an inner layer of cloth insulation;

(iii) a second inner cloth layer attached circumferentially to said first outer cloth layer at the top and at the bottom of said pocketed sleeved member thus confining said inner layer of cloth insulation therebetween;

(iv) a third inner layer of cloth attached circumferentially to said second inner layer and said first outer layer at the bottom of said pocketed sleeved member with the top of said third inner layer of cloth being open; and (v) a plurality of vertical seams in said sleeved member displaced essentially equal distance around said sleeved member thus creating a plurality of internal open topped pockets between said second and third inner layer of cloth; and (b) a plurality of plastic bags adapted to hold a freezeable liquid and further adapted to be inserted into said pockets to cool an object placed within said insulated cloth pocketed sleeved member.

2. A barrel cooler of claim 1 wherein said first, second and third cloth layers are fabricated from a single continuous sheet of cloth by folding said cloth longitudinally at about the one-third width and the two-thirds width positions, with said inner layer of cloth insulation inserted between said first and second folded layers and then stitched closed at the lower folded end and wherein said plurality of vertical seams are stitched through all of said layers.

3. A barrel cooler of claim 2 further comprising a plurality of snap releaseable carrying handles attached to the top of said insulated cloth pocketed sleeved member.

* * * * *